US005483889A

United States Patent [19]

Hoberock et al.

[11] Patent Number: 5,483,889

[45] Date of Patent: Jan. 16, 1996

[54] AUTOMATIC MEDIA SIZE DETECTOR

[75] Inventors: Tim M. Hoberock, Boise; John W. Huffman, Meridian, both of Id.

[73] Assignee: Hewlett-Packard Company, Palo Alto, Calif.

[21] Appl. No.: 444,599

[22] Filed: May 19, 1995

[51] Int. Cl.[6] ..... B41F 13/24

[52] U.S. Cl. ..... 101/232; 200/61.61; 200/61.58 R; 364/560; 400/708.1; 271/265.01; 355/311

[58] Field of Search ..... 101/232; 200/61.58 R, 200/61.13, 61.19, 61.61; 271/265.04, 265.01, 265.02; 364/560, 561, 562, 563; 400/708, 708.1; 355/311

[56] References Cited

U.S. PATENT DOCUMENTS

| | | | |
|---|---|---|---|
| 3,310,304 | 3/1967 | Folas et al. | 101/232 |
| 3,569,642 | 3/1971 | Grover | 200/61.13 |
| 4,942,814 | 7/1990 | Sugiyama | 101/232 |
| 5,107,400 | 4/1992 | Kobayashi | 200/61.58 R |
| 5,208,902 | 5/1993 | Kumon | 400/708.1 |
| 5,436,418 | 7/1995 | Tamehira | 200/61.58 R |

*Primary Examiner*—Eugene H. Eickholt
*Attorney, Agent, or Firm*—Anthony J. Baca

[57] ABSTRACT

The present invention is an apparatus for conveying the size of a media to a printing system. The apparatus is constructed from a tray that has several receiving positions, one position for each size of media. A plurality of conductive strips are attached to the top of the tray. Additionally, the conductive strips are arranged to be in contact with the printing system when the tray is inserted in the printing system. An insulating label is placed over the conductive strips. The insulating label has a unique pattern of holes for each of the receiving positions in the tray. Finally there is a back-stop attached to the tray in one of the receiving positions. The back-stop attaches over the label and has connections on the bottom of the back-stop arranged to make electrical contact through the unique pattern of holes with the conductive strips. Because the back-stop rests against the media, the printing system can read the position of the back-stop by reading the unique code created by the electrical connection between the back-stop and the conductive strips.

9 Claims, 8 Drawing Sheets

| PAPER SIZE | LINE 19 | LINE 20 | LINE 21 | 22 |
|---|---|---|---|---|
| 11" x 17" | 0 | 1 | 0 | 1 |
| A3 | 1 | 1 | 0 | 0 |
| B4 | 1 | 0 | 1 | 0 |
| LEGAL | 0 | 1 | 1 | 1 |
| LETTER | 1 | 0 | 1 | 1 |
| A4 | 0 | 1 | 0 | 0 |
| EXECUTIVE | 1 | 1 | 0 | 1 |
| B5 | 1 | 0 | 0 | 0 |
| A5 | 0 | 0 | 1 | 0 |

*LINE 23 IS GROUND

FIG. 8

AUTOMATIC MEDIA SIZE DETECTOR

TECHNICAL FIELD

The present invention relates to paper trays and more particularly, to an automatic media size detection that indicates to the printer the size of the media presently in the paper tray.

BACKGROUND OF THE INVENTION

In the art of printing, it is desirable that the printing device know the size of the paper, or media, in the supply tray. Without paper size information, an error can occur during printing if the paper size requested is not the same as the paper size in the supply. If the printing system knows the paper size in the supply tray, the user can be notified that the present paper supply does not agree with the requested size, thereby, reducing the likelihood of an error.

Prior to the present invention, several methods of conveying the contents of a paper tray to the printing device have been developed. For example, a unique tray for each size of paper that the printing device can accommodate will insure that only one size of paper can be inserted in the tray. The primary disadvantage with this approach is increased cost in molding numerous size and configured trays. Additional disadvantages include increased cost in maintaining inventory of these numerous trays. For the user, they must accommodate storage of those trays not presently in use. Also, the user generally must purchase, at an additional cost, trays which are not initially provided with the printer.

Another approach, allows the manufacturer to manufacture one type of paper tray that can be configured for the various sizes of paper. This approach reduces manufacturing cost by requiring one molding for all paper trays. However, it requires that the user indicate to the printer the size of paper in the tray. A common method of indicating to the printer the size of paper in the tray requires the user to actually "punch out" a particular location in the paper tray. Once punched out, the tray is permanently configured for that particular paper size. If the user wishes to use a different paper size, the user must purchase a new tray.

Yet another approach to solving this problem requires the user to rotate a knob or the like on the tray to convey the size of the paper in the tray to the printer. The knob, in turn, manipulates levers located on the side of the printer tray. When the paper tray is installed into the printer, the levers actuate switches on the printer thereby communicating the size of the paper the user has indicated. No feedback exists to insure that the paper size selected is the same as the paper in the tray.

SUMMARY OF THE INVENTION

The present invention is an apparatus for holding media and conveying the media's size to a printing system. The apparatus is constructed from a tray that has several receiving positions, one position for each size of media. A plurality of conductive strips are attached to the top of the tray. The conductive strips are arranged to be in contact with the printing system when the tray is attached to the printing system. An insulating label is placed over the conductive strips. The insulating label has a unique pattern of holes for each one of the receiving positions in the tray. Each unique pattern of holes is placed over the conductive strips. Finally there is a back-stop attached to the tray in one of the receiving positions. The back-stop attaches over the label and has connections on the bottom of the back-stop arranged to make electrical contact through the unique pattern of holes with the conductive strips. Because the back-stop rests against an edge of the media, the printing system can read the position of the back-stop by reading the unique code created by the electrical connection between the back-stop and the conductive strips.

BRIEF DESCRIPTION OF THE DRAWINGS

A better understanding of the invention may be had from the consideration of the following detailed description taken in conjunction with the accompanying drawings in which:

FIG. 8 is a truth table representation of the electrical coding produced by using the label in FIG. 6.

DETAILED DESCRIPTION OF THE PREFERRED EMBODIMENTS

Figure 1:
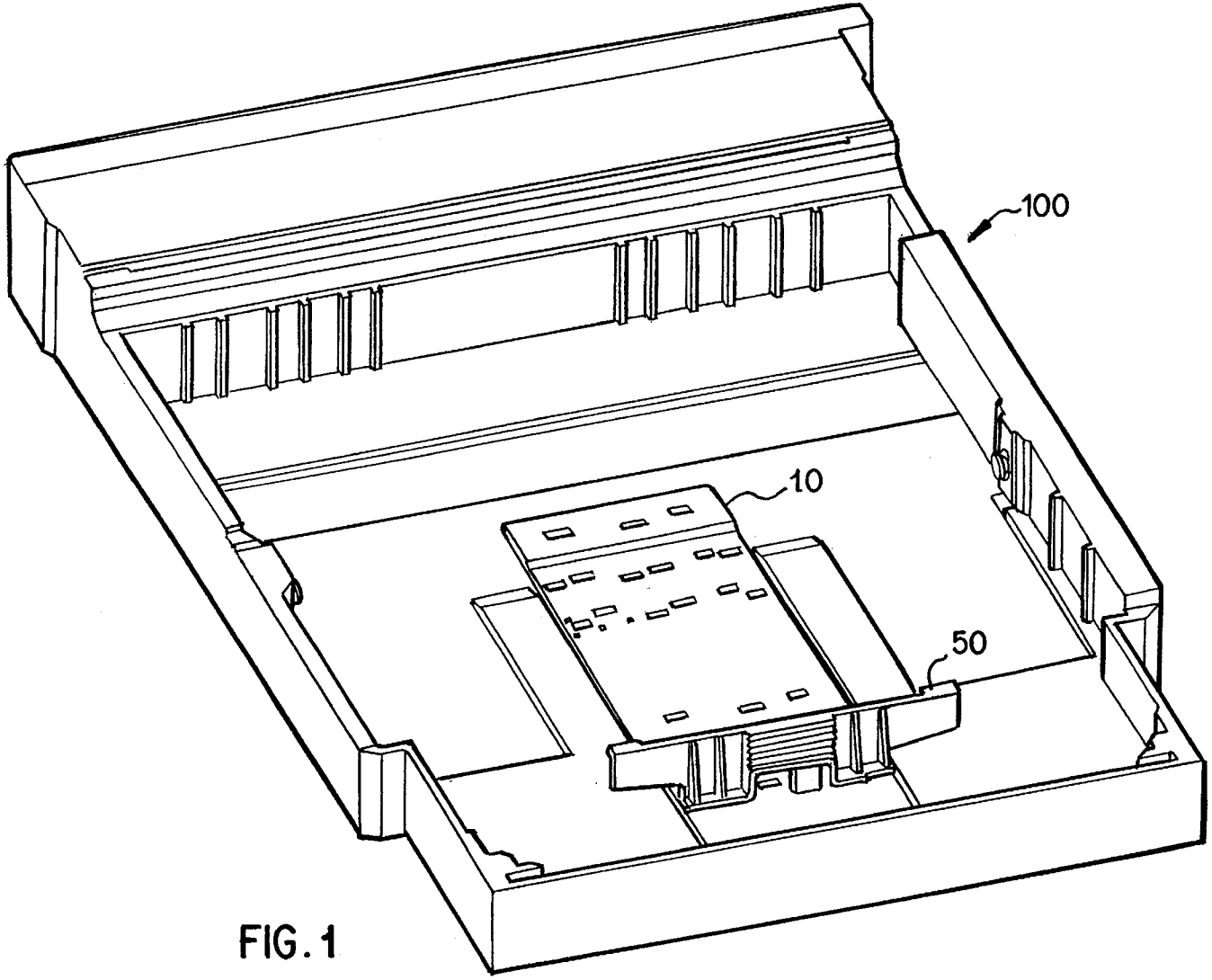
FIG. 1 is a perspective view of the preferred embodiment in accordance with the present invention.

The present invention is not limited to a specific embodiment illustrated herein. Referring first to FIG. 1 where a preferred embodiment of the present invention is shown. The preferred embodiment uses the paper tray media backstop 50 as a switch to communicate to the printer the size of the paper in the paper tray 100. The user must properly adjust the paper tray media backstop 50 to correctly fit the paper into the tray. In doing this, the paper tray 100 is automatically configured to indicate to the printer the present paper size.

Figure 2:
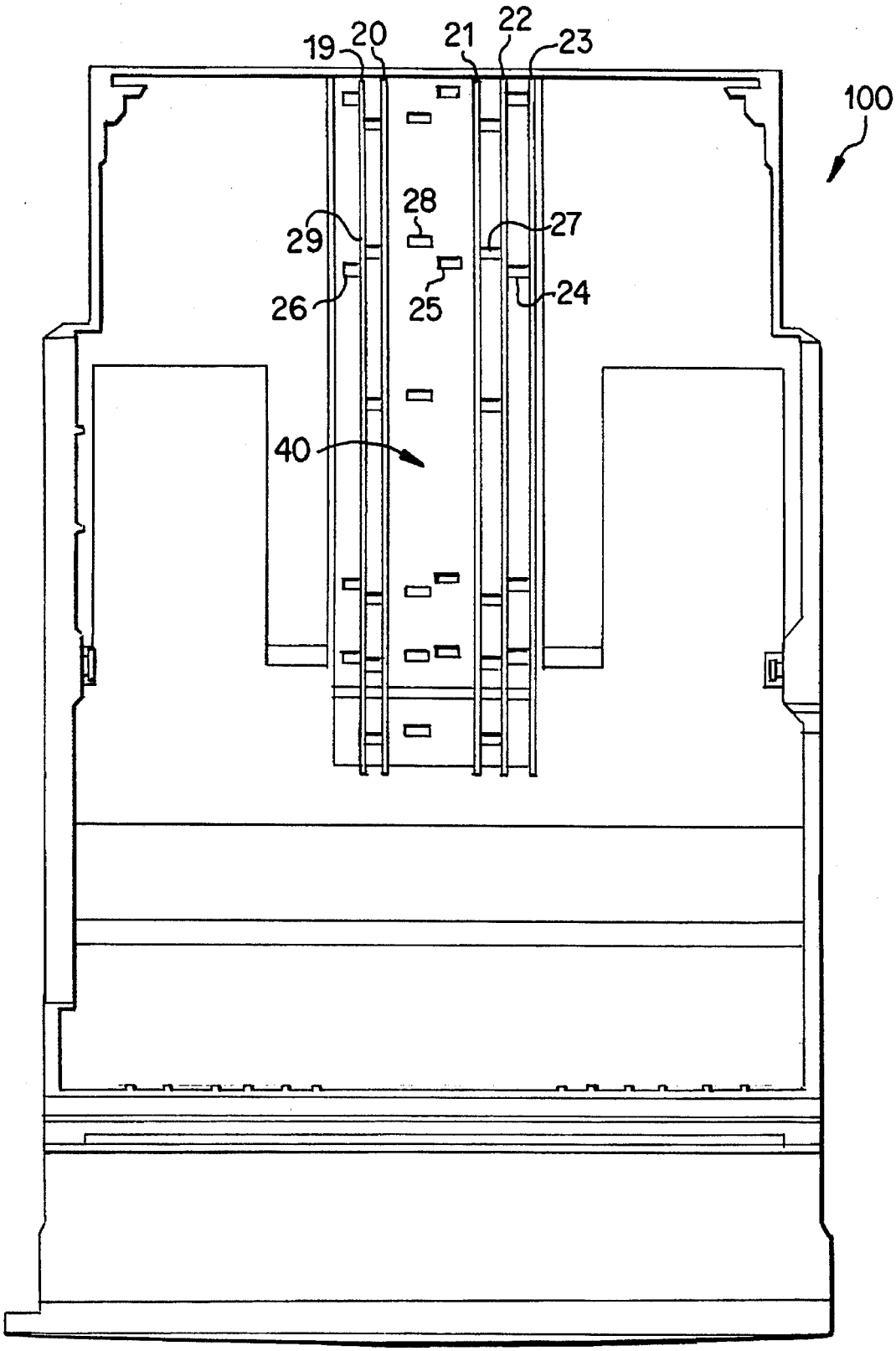
FIG. 2 is a top view of a paper tray with the label removed to more clearly show the conductive strips.

Still referring to FIG. 1 and the aid of FIG. 2, the preferred embodiment consists of five conductive strips 19 through 23, which run from the front of the paper tray 100 to the back. These five conductive strips (19–23) are positioned such that they make electrical connection with a spring loaded, conductive strip located on the bottom of the paper tray media back stop 50. A label 10 or other non-conductive material is placed over the five conductive strips (19–23). For each paper tray media backstop 50 location, label 10 has a unique arrangement of holes that allow the spring loaded, conductive strip of the paper tray media backstop 50 to electrically connect with the conductive lines (19–23). Thus, for each location paper tray media backstop 50 position, a unique combination of conductive lines are electrically connected together. When paper tray 100 is properly installed in the printer, the printer reads the unique combination.

Referring now to FIG. 2 where a top view of the preferred embodiment is shown. Paper tray 100 is shown to include conductive strips 19–23 embedded in basin 40. Label 10 has been removed to clearly show that conductive strips 19–23 are positioned along the length of basin 40. Holes 27, 28 and 29 are arranged to receive the paper tray backstop 50 not shown. While it may not be apparent, in the present embodiment, two versions of the backstop 50 are available. A first version for metric measured paper is arranged to have tabs aligned with holes 27, 28 and 29. A second paper tray backstop is reconfigured to mate with holes 24, 25 and 26. Having two different back stops is not necessary to the present invention.

Figure 3:
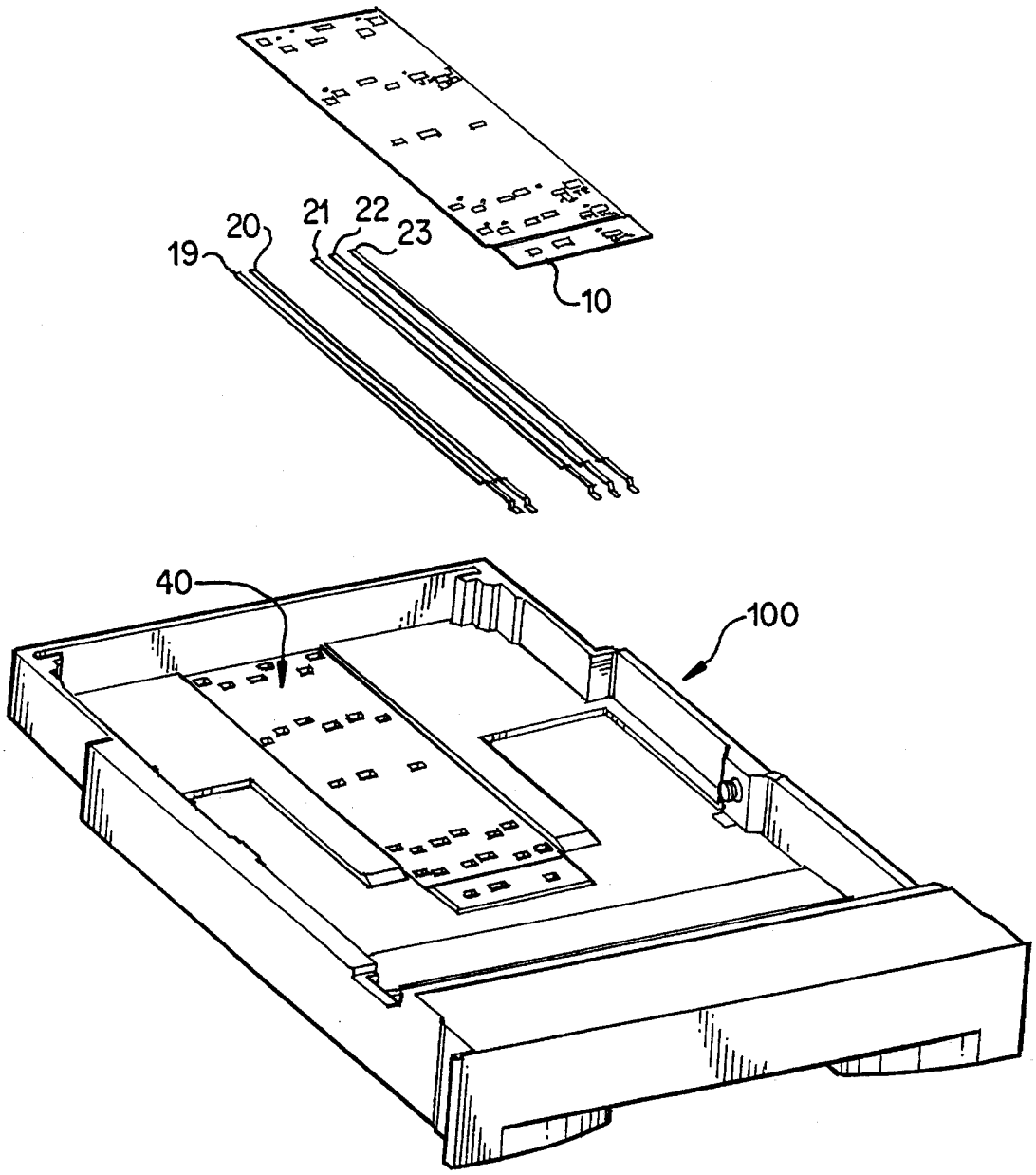
FIG. 3 is a perspective view of the preferred embodiment showing the relationship of the paper tray, conductive strips and label.

Referring briefly to FIG. 3 where an isometric view of paper tray 100, conductive strips 19–23, and label 10 are shown. FIG. 3 shows that paper tray 100 receives conductors 19 through 23 in basin 40. Label 10 is then placed over the top of conductors 19 through 23. The routing of conductor strips 19 through 23 is not shown in FIG. 3. One skilled in the art will understand that there are numerous ways of routing the conductive strips such that they are accessible by the printer. As such, the exact implementation will be printer dependent and therefore is not important to understand the present invention.

Figure 4:
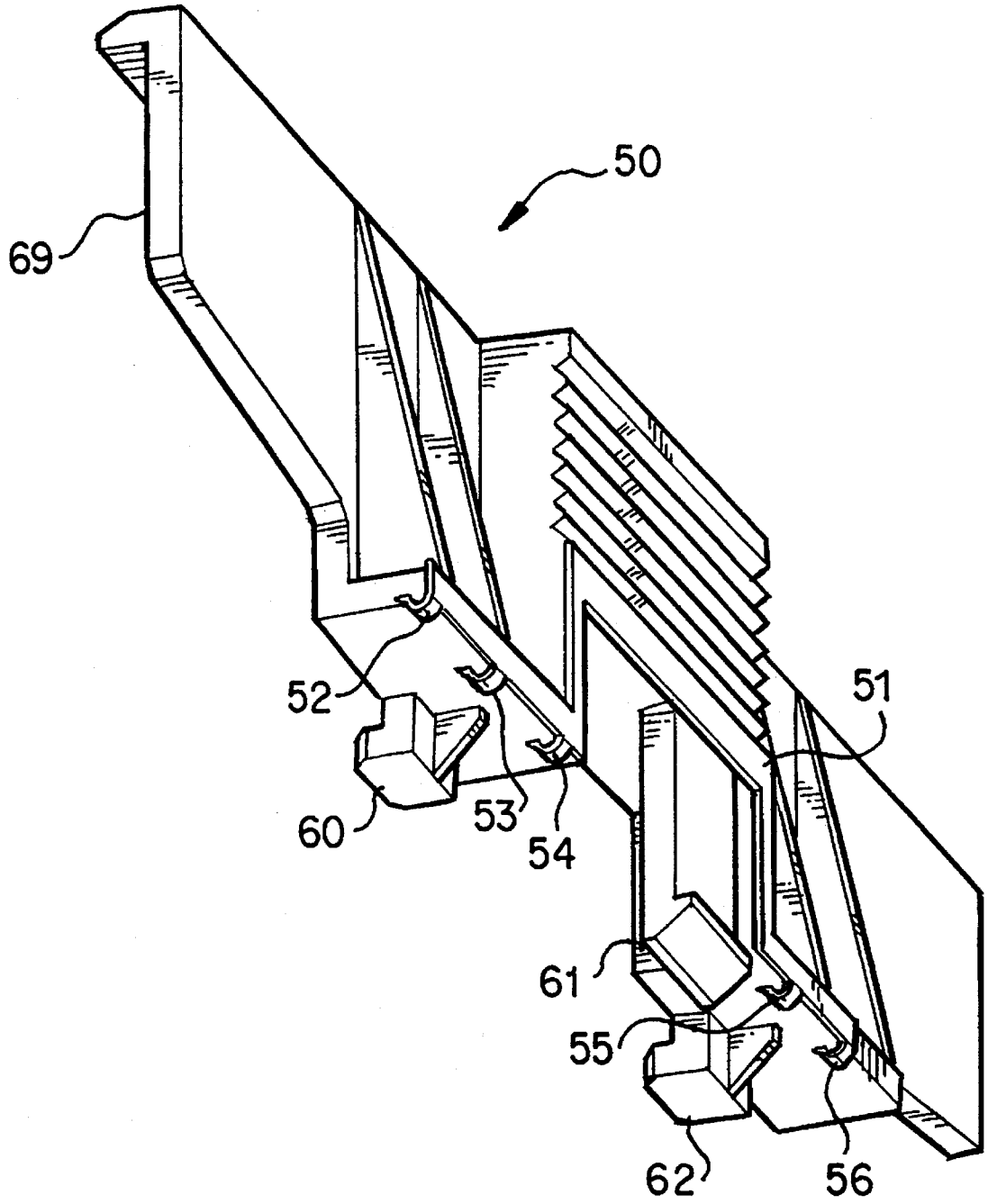
FIG. 4 show the metric version of the paper back-stop.
Figure 5:
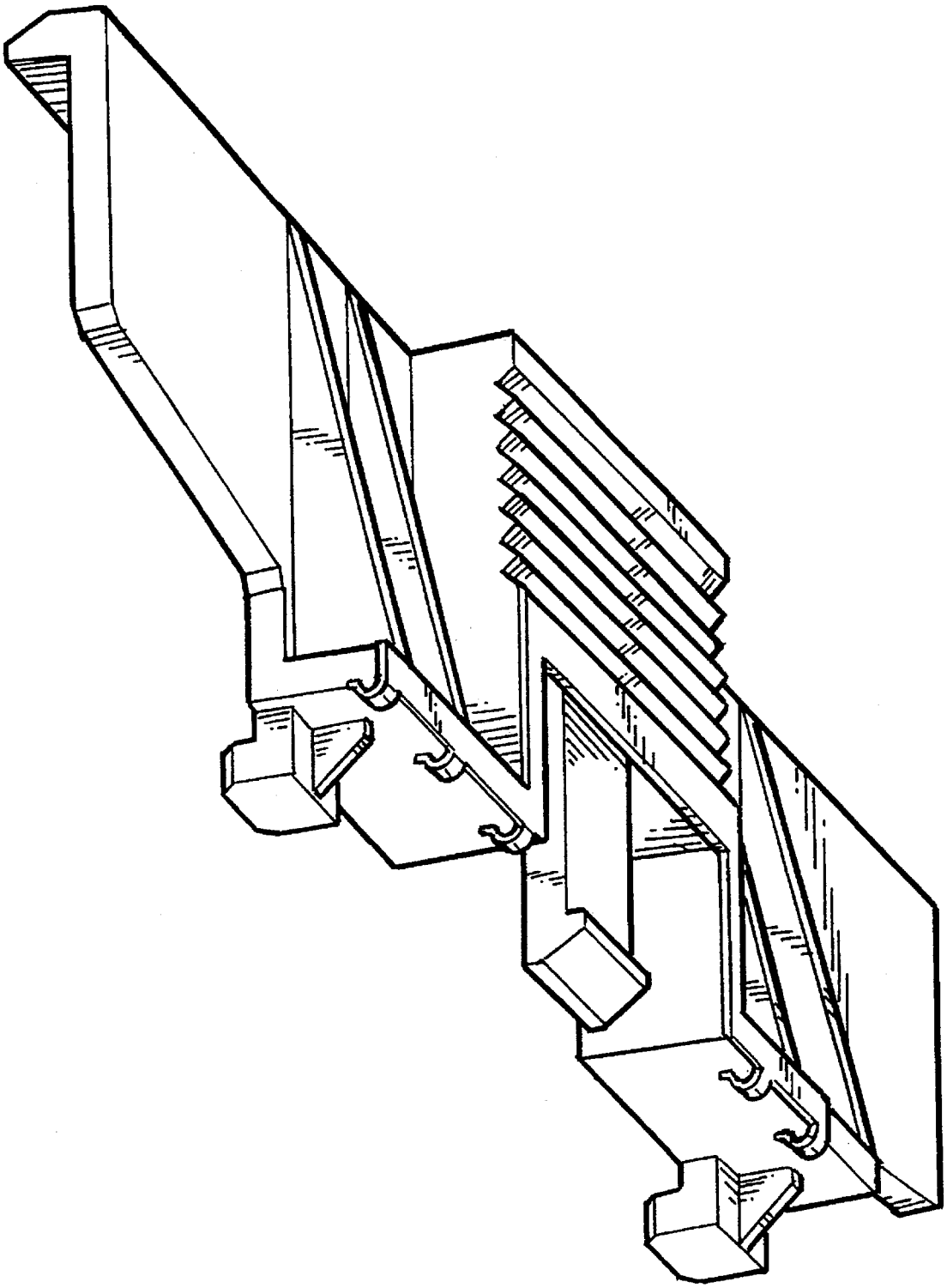
FIG. 5 show the US version of the paper back-stop.

The paper backstop 50 is shown in greater detail in FIG. 4. Protrusions 60, 61 and 62 are formed in a way as to mate with holes 27, 28 and 29 of FIG. 2. As mentioned earlier another configuration for paper backstop 50 is also available (See FIG. 5). This configuration is generally identical to that shown in FIG. 4 however, tabs 60, 61 and 62 are arranged to mate with holes 24, 25 and 26 of FIG. 2. Focusing on the configuration as shown in FIG. 4, a conductive strip 51 is shown attached to the paper backstop 50. This conductive strip 51 has spring loaded contacts 52, 53, 54, 55 and 56. It is these spring loaded contacts which make electrical contact with the conductive strips 19 through 23.

When paper backstop 50 is inserted in paper tray 100 such that the paper in the tray butts against paper backstop in the general area of 69, electrical contacts 52 through 56 may make contact with the conductive strips 19 through 23 depending upon whether label 10 has a corresponding opening in which the electrical contacts may pass.

Figure 6:
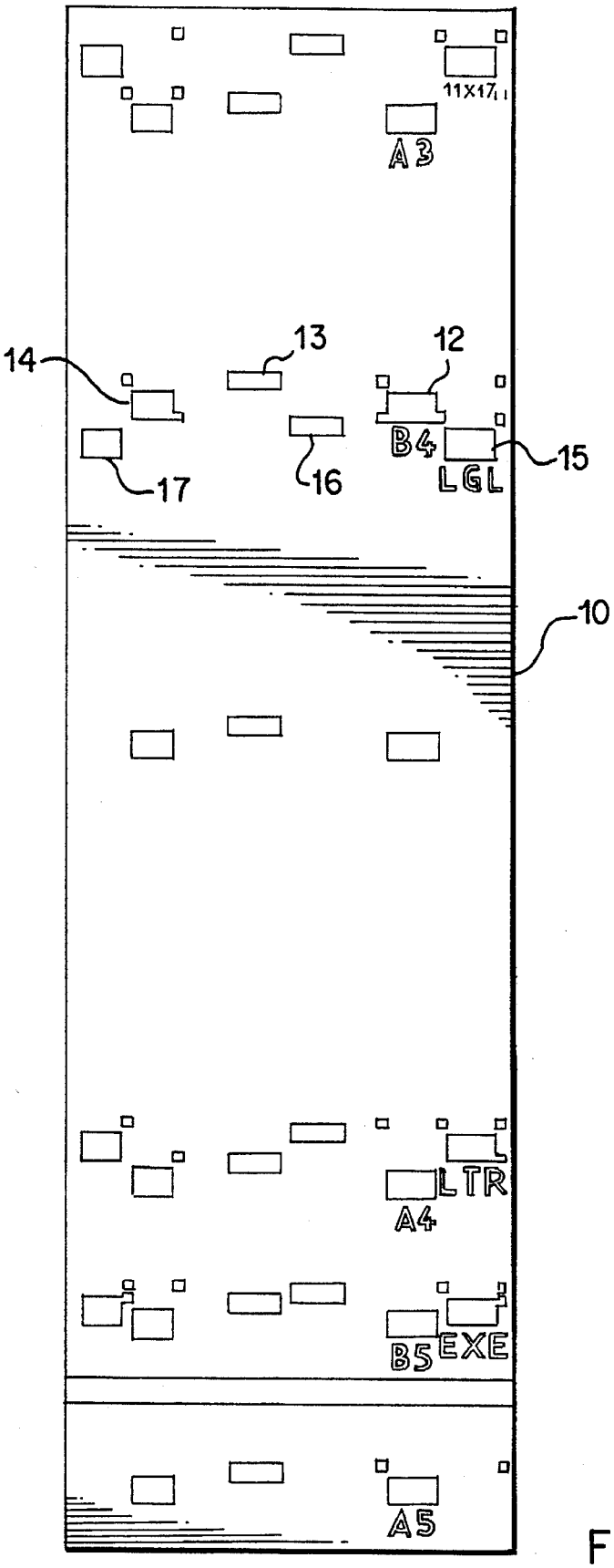
FIG. 6 show the preferred embodiment of the label.

By way of an example, FIG. 6 shows a preferred embodiment of the label 10. Once label 10 is placed over conductive strips 19 through 23, a unique pattern will be created whenever the backstop 50 is inserted in an appropriate location. As shown in FIG. 6 assuming the paper backstop 50 is inserted into holes 12, 13, and 14, the conductive strip 51 will electrically connect conductive strips 19, 21 and 23. In a similar manner, if the paper backstop 50 is inserted holes 15, 16, and 17, conductive strips 20, 21, 22, and 23 are electrically connected through conductive strip 51.

Figure 7:
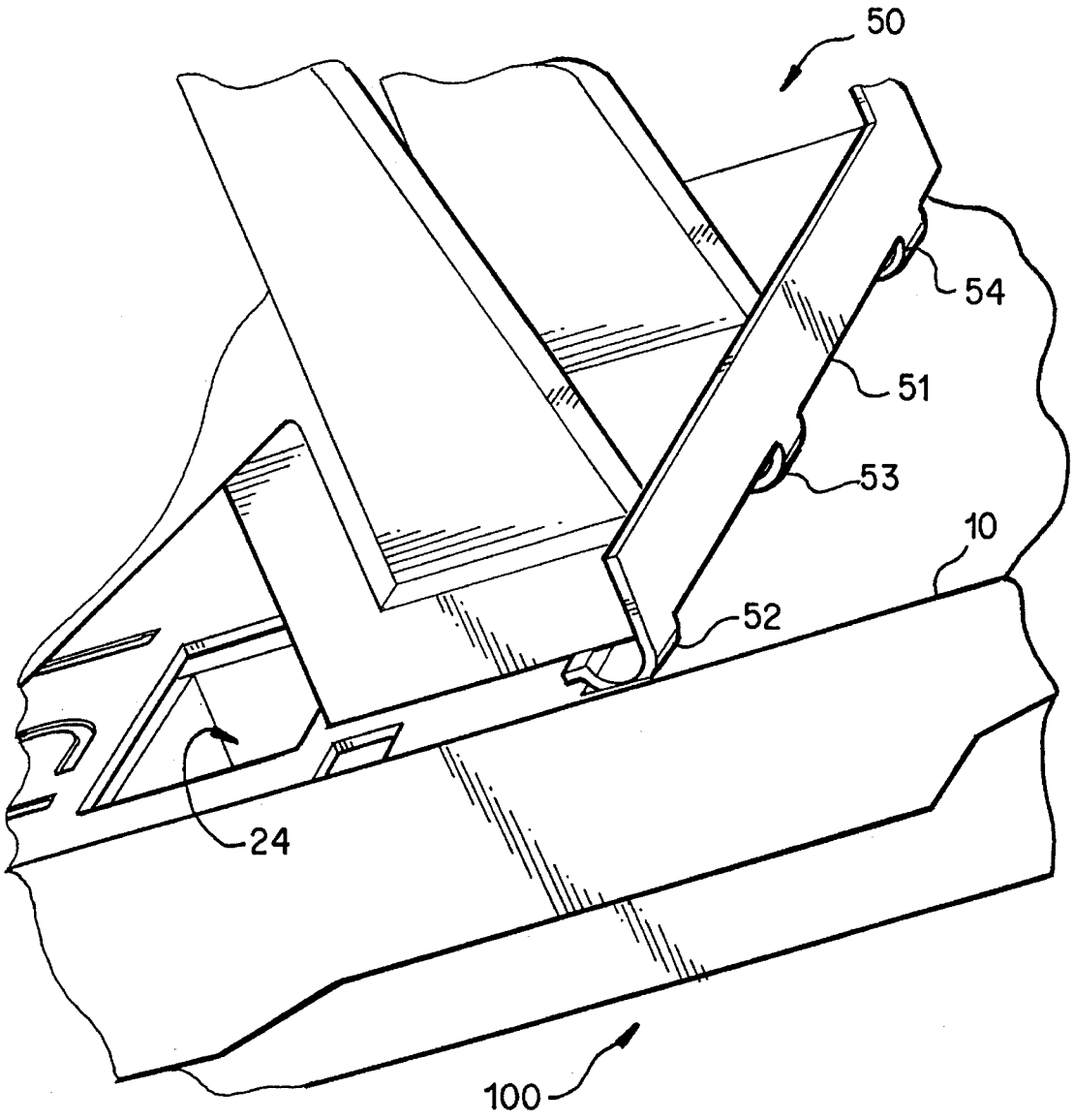
FIG. 7 is a close-up isometric view of the back-stop 50 in the "B4" position.

FIG. 7 provides a close-up isometric view of the back-stop 50 in the "B4" position. The position of back-stop 50 can be determined by noticing that just below hole 24 is the top of the word "LGL". Thus, FIG. 6 indicates that the back-stop must be in the "B4" position. Referring back to FIG. 7 it should be clear that contact 52 passes through label 10 to make contact with conductive strip 23 (not shown). While it is not as clear in FIG. 7, contact 53 rests on top of label 10, while contact 54 passes through.

One skilled in the art can continue the analysis of electrical connections for label 10. Upon completion of such analysis, the truth table of FIG. 8 becomes evident. It is this truth table, that the printer uses to determine a location of the page paper backstop 50 and thus, the size of the paper in the tray.

After having read the above specification one skilled in the art will understand that the exact number of conductive strips depends on a particular application. Other simple modifications may include reconfiguration of the paper tray back stop 50, as well as a different paper tray to allow the use of a single paper backstop. Other modifications envisioned by this invention include alternative arrangements for the spring loaded member 51 allowing the electrical tabs 52 through 55 to be accomplished through numerous embodiments.

While the preferred embodiment has been described in conjunction with an electrophotographic printer, the present invention is equally applicable to other types systems. Such systems include facsimile machines, ink jet printers, dot matrix printers, copiers and the like.

Although the preferred embodiment of the invention has been illustrated and that form described, it is readily apparent to those skilled in the art that various modifications may be made therein without departing from the spirit of the invention or from the scope of the appended claims.

What is claimed is:

1. An apparatus for holding media and conveying said media's size to a printing system, said apparatus comprising:

a tray having a top and a plurality of receiving positions, said media sets in said tray, said tray attaches to said printing system;

a plurality of conductive strips attached to said top of said tray, said plurality of conductive strips arranged to be in contact with said printing system when said tray is attached to said printing system;

an insulating label placed over said plurality of conductive strips, said insulating label having a unique pattern of holes over said plurality of conductive strips for each one of said plurality of receiving positions in said tray; and a back-stop attached to said tray in one of said plurality of receiving positions, said back-stop attaches over said insulating label, said back-stop having a plurality of connections arranged to make electrical contact with said plurality of conductive strips through said unique pattern of holes, said back-stop rests against an edge of said media.

2. The apparatus as claimed in claim 1 wherein said back-stop is removably attached to said tray.

3. The apparatus as claimed in claim 2 wherein:

each of said plurality of receiving positions is formed by at least two indentations; and said back-stop further comprising at least two tabs positioned to mate with said at least two indentations.

4. The apparatus as claimed in claim 1 wherein:

said electrical contact between said plurality of connections and said plurality of conductive strips creates a unique electrical pattern; and said printing system being in contact with said plurality of conductive strips receives said unique electrical pattern.

5. An apparatus comprising:

a tray;

a plurality of conductive strips attached to said tray;

an insulating label placed over said plurality of conductive strips; and a back-stop attached to said tray over said insulating label, said back-stop having a plurality of connections arranged to make electrical contact with said plurality of conductive strips through said insulating label.

6. The apparatus as claimed in claim 5 wherein:

said tray having a plurality of receiving positions;

said insulating label having a unique pattern of holes for each one of said plurality of receiving positions in said tray, said unique pattern of holes being over said plurality of conductive strips; and said back-stop makes said electrical contact with said plurality of conductive strips through said unique pattern of holes.

7. The apparatus as claimed in claim 6 wherein:

said tray attaches to a printing system; and said plurality of conductive strips arranged to be in contact with said printing system when said tray is attached to said printing system.

8. The apparatus as claimed in claim 6 wherein:

each of said plurality of receiving positions is formed by at least two indentations; and said back-stop further comprising at least two tabs positioned to mate with said at least two indentations.

9. The apparatus as claimed in claim 7 wherein:

said electrical contact between said plurality of connections and said plurality of conductive strips creates a unique electrical pattern; and said printing system being in contact with said plurality of conductive strips receives said unique electrical pattern.

* * * * *